US010155231B2

(12) United States Patent
Strauch et al.

(10) Patent No.: US 10,155,231 B2
(45) Date of Patent: Dec. 18, 2018

(54) DRIVE APPARATUS FOR A SEPARATOR ARRANGEMENT

(71) Applicant: GEA Mechanical Equipment GmbH, Oelde (DE)

(72) Inventors: Dieter Strauch, Oelde (DE); Thomas Bathelt, Oelde (DE); Andreas Bolte, Ahlen (DE)

(73) Assignee: GEA Mechanical Equipment GmbH, Oelde (DE)

( * ) Notice: Subject to any disclaimer, the term of this patent is extended or adjusted under 35 U.S.C. 154(b) by 913 days.

(21) Appl. No.: 14/402,397

(22) PCT Filed: May 15, 2013

(86) PCT No.: PCT/EP2013/060083

§ 371 (c)(1),
(2) Date: Nov. 20, 2014

(87) PCT Pub. No.: WO2013/174701

PCT Pub. Date: Nov. 28, 2013

(65) Prior Publication Data

US 2015/0141231 A1 May 21, 2015

(30) Foreign Application Priority Data

May 22, 2012 (DE) ..... 10 2012 104 411

(51) Int. Cl.
*B04B 9/12* (2006.01)
*B04B 9/04* (2006.01)
(Continued)

(52) U.S. Cl.
CPC ..... *B04B 9/12* (2013.01); *B04B 7/06* (2013.01); *B04B 9/00* (2013.01); *B04B 9/04* (2013.01); *B04B 15/00* (2013.01)

(58) Field of Classification Search
CPC .... B04B 9/04; B04B 9/12; B04B 9/00; B04B 7/06; B04B 15/00
(Continued)

(56) References Cited

U.S. PATENT DOCUMENTS 3,272,136 A * 9/1966 Franzén ..... F04D 15/0077 310/52
4,104,551 A * 8/1978 Blank ..... H02K 5/136 252/194
(Continued)

FOREIGN PATENT DOCUMENTS

DE 10 2007 060 588 A1 6/2009
DE 10 2007 061 999 A1 6/2009
(Continued)

OTHER PUBLICATIONS

European Office Action issued in European counterpart application No. 13 724 561.9-1018 dated Feb. 15, 2018 (Six (6) pages).

*Primary Examiner* — Walter D. Griffin
*Assistant Examiner* — Shuyi S. Liu
(74) *Attorney, Agent, or Firm* — Crowell & Moring LLP

(57) ABSTRACT

A separator drum having a vertical rotation axis and an inflow line for a material which is to be processed by centrifuging is driven by a drive apparatus via a drive spindle. The drive spindle is rotated by a motor designed as a direct drive and having a stator and a rotor. The drive apparatus is arranged in a drive housing having a motor housing section designed as an explosion-protected structure that is encapsulated in a pressure-resistant manner and in which the motor is accommodated.

19 Claims, 7 Drawing Sheets

(51) Int. Cl.
*B04B 7/06* (2006.01)
*B04B 9/00* (2006.01)
*B04B 15/00* (2006.01)

(58) Field of Classification Search
USPC ..... 494/15, 83, 84
See application file for complete search history.

(56) References Cited

U.S. PATENT DOCUMENTS

| | | | | |
|---|---|---|---|---|
| 2006/0276321 | A1* | 12/2006 | Pitkamaki | B04B 9/04 494/15 |
| 2009/0233780 | A1 | 9/2009 | Mackel et al. | |
| 2010/0255976 | A1 | 10/2010 | Mackel et al. | |
| 2014/0249012 | A1* | 9/2014 | Mackel | B04B 9/04 494/15 |

FOREIGN PATENT DOCUMENTS

| | | | | |
|---|---|---|---|---|
| DE | 10 2008 059 335 | A1 | 6/2009 | |
| DE | 102008059335 | A1 * | 6/2009 | B04B 9/04 |
| DE | 102009019950 | A1 * | 11/2010 | B04B 9/04 |
| DE | 20 2011 002 408 | U1 | 6/2012 | |
| EP | 2 040 355 | A2 | 3/2009 | |
| EP | 2 181 770 | A1 | 5/2010 | |
| EP | 2181770 | A1 * | 5/2010 | B04B 9/04 |
| EP | 1 617 952 | B2 | 12/2012 | |
| WO | WO 2007/125066 | A1 | 11/2007 | |
| WO | WO 2010/105742 | A2 | 9/2010 | |

* cited by examiner

DRIVE APPARATUS FOR A SEPARATOR ARRANGEMENT

BACKGROUND AND SUMMARY OF THE INVENTION

Exemplary embodiments of the invention relate to a drive apparatus for a separator arrangement.

PCT international patent document WO 2007/125066 A1 discloses a separator with a direct drive, the drive apparatus of which features an electric drive motor with a stator and a rotor, or motor rotor, which aligns with the drive spindle. The stator is rigidly connected to the machine frame, and the motor rotor, the drive spindle, the centrifuge drum and the housing form a unit that is elastically supported on the machine frame and oscillates during operation. In this case, the bearing device is arranged between the motor and the drum. The lubricating system of the bearing devices can be accommodated above a partition over the drive motor.

Further examples of separators with direct drive are found in German patent documents DE 10 2007 060 588 A1 and DE 10 2007 061 999 A1, as well as European patent document EP 1 617 952 B2.

German patent document DE 10 2008 059 335 A1 discloses further improvements to the construction and the arrangement of the lubricating system of separators with vertical rotational axis by having the lubricant system for lubricating the bearing arrangement, which is preferably designed as a lubricant circuit, and a lubricant collecting reservoir, wherein the entire lubricant circuit and at least the lubricant collecting reservoir are preferably arranged axially above the motor rotor of the electric drive motor, and wherein lubricant can be fed from the lubricant collecting reservoir directly into the region of the neck bearing, or into the region above the neck bearing, through a lubricant passage formed in or on the housing and extending into the area of the neck bearing, or into the area above the neck bearing, wherein the entire bearing arrangement of the drive spindle is arranged axially above the lower base of the lubricant collecting reservoir.

This constructional form has proved to be inherently successful since it is of a particularly short construction. The spindle, since it is preferably not used for the lubricant circuit, can be used for other tasks such as a product feed, e.g. through a hollow spindle.

For different applications of separators, it is also necessary, however, to design the components so that they can be used in a so-called hazardous area, i.e. the motors are to be of a pressure-tightly encapsulated design, especially based on standard EN 60079 part I or—in countries outside the EU—possibly based on corresponding national standards.

Therefore, there is a requirement for a suitable explosion-proof design of the drive apparatus for the separator or for the creation of an explosion-proof separator drive. The creation of such a drive apparatus is therefore the object of the invention.

In summary, one or a plurality of subsequent advantageous features are realized, common to which is the fact that they advantageously promote or enable the realization of a particularly advantageous drive apparatus of explosion-proof design for separators.

First of all, the drive is preferably realized as a direct drive since this offers the advantage of a compact constructional form so that the design of explosion-proof type is facilitated. The drive spindle by its one end thereby supports the separator drum in a rotation-resistant manner. At the opposite end of the drive spindle, on the other hand, in a preferred embodiment, the rotor of the motor is fastened on the spindle in a rotation-resistant manner.

In this case, the motor housing section—or preferably even only the motor housing section—which accommodates the motor with the stator and the rotor, is especially of a pressure-tightly encapsulated design. The motor housing section preferably only has the stator and the rotor. The construction preferably includes only a single (upper) rotary transmission lead-through between rotating and stationary parts of the drive, which makes it significantly easier to achieve the pressure-tight encapsulation.

Preferably, for ensuring a compact type of construction, the separator bearing arrangement is furthermore located partially, or preferably completely, between the separator drum and the motor, especially the rotor of the motor, wherein the bearing arrangement can consist of two spaced-apart bearing devices at spaced-apart bearing points.

The fact that the motor in a preferred embodiment manages without a separate bearing arrangement and the bearing arrangement of the separator is also used for the pressure-tightly encapsulated motor, is advantageously made possible according to an especially preferred variant by the inclusion of drive parts of the separator in relation to, or in, the pressure-tightly encapsulated space.

The bearing points can be lubricated in a first advantageous variant by means of an oil-circulating lubricating system. As a second advantageous variant, a minimum-quantity lubricating system (with oil droplets injected into the region of the bearings at specified intervals) is a possibility. The bearing housing does not have to be especially encapsulated, although this can be provided since no electrical components are present or accommodated there.

Since with the last-named lubricating variant only a small amount of oil is consumed, the feed into an explosion-proof space is simplified since the passage for injecting the very small amount of oil needs to be only of very small design.

It is also advantageous, in this case compact and simple, if the motor with its motor housing section is flanged on the bearing housing section of the separator. If the motor housing section with the stator and the rotor is of a pressure-tightly encapsulated design in an explosion-proof type of construction, such an encapsulation can again be advantageously dispensed with in the region of the bearing housing section, which simplifies the construction. This is especially made possible in a simple manner when the entire bearing device—and preferably the lubricating system for oil feed and possibly oil discharge—is arranged in/on the bearing housing section above the actual motor or the motor components.

The entire drive is preferably decoupled from the separator frame with regard to vibrations and is furthermore advantageously and simply supported on this by means of elastic spherical bearings.

It is advantageous if the natural frequency of this system is matched to a range of <1300 revolutions per minute, preferably <1100 revolutions per minute. It should especially not lie on a resonance frequency of the system and not lie close to the resonance range either. The operating speed should preferably deviate from these frequencies/rotational speeds by at least +/−5%, especially +/−10%.

It is particularly advantageous if the motor housing section has a cover part vertically towards the top that is adjacent to the rotating part so that the gap is formed between the cover part and the rotating part. In this case, according to a first advantageous variant, the gap is formed between the cover part of the motor housing section and the lubricant collecting reservoir and, according to a second variant which is to be advantageously realized, one of the gaps, or the gap, is formed between the cover part and the drive spindle. The motor can be closed off towards the bottom. The motor housing section, according to a further advantageous embodiment which supplements the advantageous variants of the previous paragraph, is closed off towards the bottom in a simple manner with a preferably detachably fastened cover which, if it is detachable, enables access to the motor on the other side. In this way, the rotary transmission lead-through is to be simply realized on one side only of the encapsulated drive.

An oil catching chamber, in which a feed element for the oil return is attached, is especially preferably also formed between the rotor and the lower rolling bearings of the separator bearing arrangement.

In this case, it is also advantageous for forming an explosion-proof type of construction if the outside diameter of the rotating catching chamber has a defined gap towards the motor housing section, which is dimensioned in such a way that a flashover is prevented in the event of an outward explosion from the interior of the motor. The dimensioning of the gap can be designed according to the invention (narrow and axially of sufficient length) so that despite the gap between rotating and non-rotating parts of the drive an explosion-proof type of construction is possible. The suitable gap dimensions can be determined in a simple test, depending on construction. This determination is necessary since, in contrast to commercially available pressure-tightly encapsulated motors with rolling bearings on both sides of the rotor, influences of the separator drum, especially in the case of unbalances, have to be taken into consideration. As a starting point, however, in this case the standard values of the applicable standards can be applied.

Alternatively (or also additionally, if applicable), this gap, or such a gap, can also be provided at another point, that is to say between the motor housing and the drive spindle or above the bearing device between a ring above the bearing device and the drive spindle.

The motor is preferably a water-cooled motor. Also, a part of the housing is preferably designed as a cooling chamber (preferably with a coolant connection to a cooling circuit) in order to compactly integrate this into the construction. An air-cooled motor, in which the air circulation is created by means of an independent external fan, is conceivable as an alternative. This fan is located beneath the motor outside the housing section. Instead of cooling chambers in the case of the water-cooled motor, the motor then has fins (not shown) for the dissipation of heat.

The stator is preferably arranged directly on the inside circumference of the motor housing section and the rotor is fastened on the outside circumference of the drive spindle in such a way that both the rotor and the stator follow precessional movements of the drum so that during operation the rotor moves radially relative to the stator only as a result of the unbalance and torque influences of the separator drum. Particularly absent up to now in the case of such constructions has been an explosion-proof design which, however, on the transmission lead-through on one side only of the motor housing can still be realized with a narrowly dimensioned gap. The entire unit (having at least the motor with stator and rotor and the motor housing section) is supported on a machine frame by means of elastic elements via the flange region.

The rotor of the motor is preferably fastened on the spindle in a simple manner by means of a screw clamp. In this case, the rotor can be drawn against a spindle collar, for example.

Alternatively, an overall interconnection can also be created, however, by the rotor being clamped against the oil catching chamber which is guided on the spindle and against at least the lower rolling bearing. In this case, a spindle collar above this rolling bearing constitutes the stop. Clamped in this context means an interconnection of the parts produced by screwing down tight.

The motor housing is especially advantageously designed in a pressure-tightly encapsulated type of construction so that it withstands an explosion pressure in the interior of the motor of a minimum of 10 bar, especially of a minimum of 15 bar. In special cases, the housing can also be designed so that it withstands a pressure of a minimum of 20 or even 30 bar.

The cover, as the lower termination of the drive housing, is preferably provided with long gaps towards the housing so that a flashover in the event of an explosion in the interior of the motor is excluded (not shown).

The rolling bearing arrangement of the separator is preferably designed so that it cannot be displaced upwards in the event of an explosion in the interior of the motor. A possible limitation of the distance is effected by means of a ring above the neck bearing. Alternatively, use is preferably made of rolling bearings having no clearance, or only a small clearance, in the axial direction.

Created as a most advantageous variant is such an explosion-proof motor housing, with motor, which can be of an explosion-proof design without the bearings and also the lubricating system having to be positioned in the interior of the pressure-tightly encapsulated area.

One reason—which is why such constructions have not been developed up to now—is the governing of the frequency matching of the elastic coupling to the machine frame which as a result of the higher mass of a commercially available explosion-proof motor is of a more complicated and more unfavorable design than with light standard motors. Furthermore, the dimensioning of the gap between rotating and stationary parts of the drive and the matching of the drive components involved are to be governed by the separator-specific influences.

A second reason is that for such applications there were previously inertized drives that by means of external, additional devices ensured safety in hazardous areas by means of a positively pressurized encapsulation with inert gas. As a result of the new drive, additional devices are dispensed with.

A further aspect is the gap and the gap length against a spark ignition in the event of an explosion. The necessary development of a precise control, another configuration, and the necessary tests have been avoided up to now in the case of separator drives.

Furthermore, up to now the rolling bearings on both sides of the rotor have always been a component part of the motor, moreover, in the case of known, pressure-tightly encapsulated motors for the hazardous area.

BRIEF DESCRIPTION OF THE DRAWING FIGURES

The invention is described in more detail below with reference to the drawing based on an exemplary embodiment. In the drawing.

DETAILED DESCRIPTION

Figure 1:
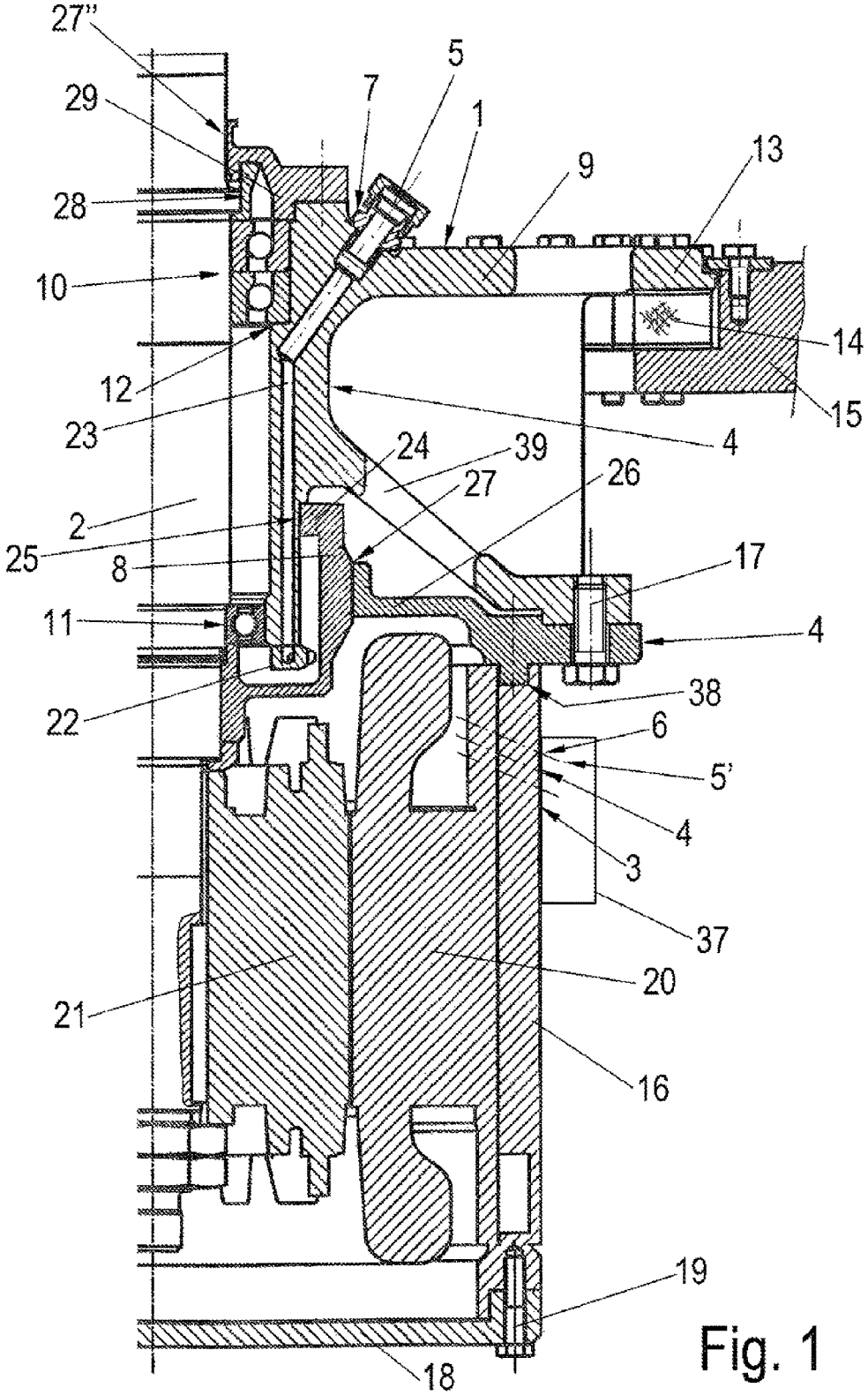
FIG. 1 shows a schematic representation of a section through a drive apparatus for a separator arrangement, of which only one half on one side of the rotational axis is shown.
Figure 2:
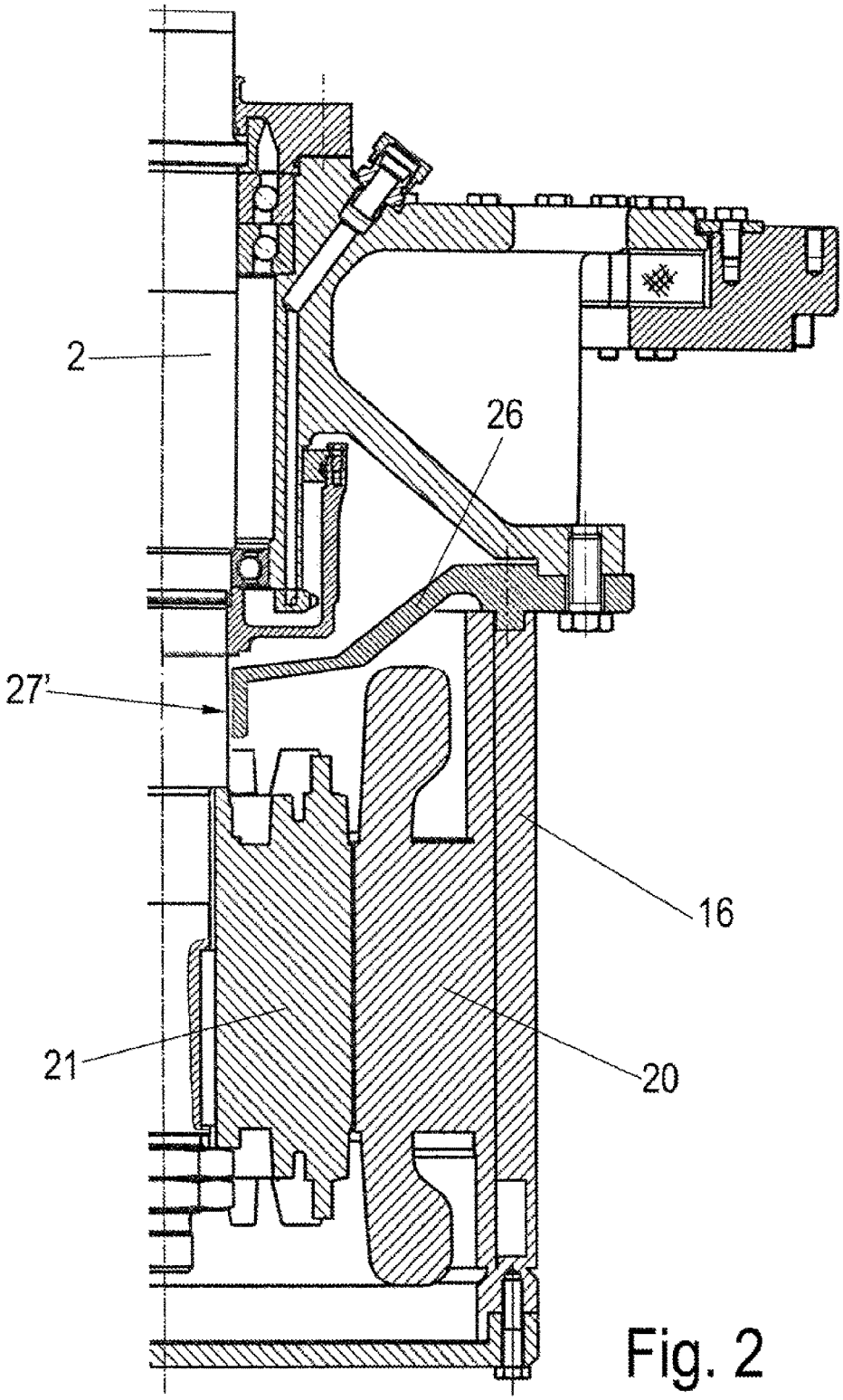
FIG. 2 shows a schematic representation of a section through a second drive apparatus for a separator arrangement, of which only one half on one side of the rotational axis is shown.
Figure 7:
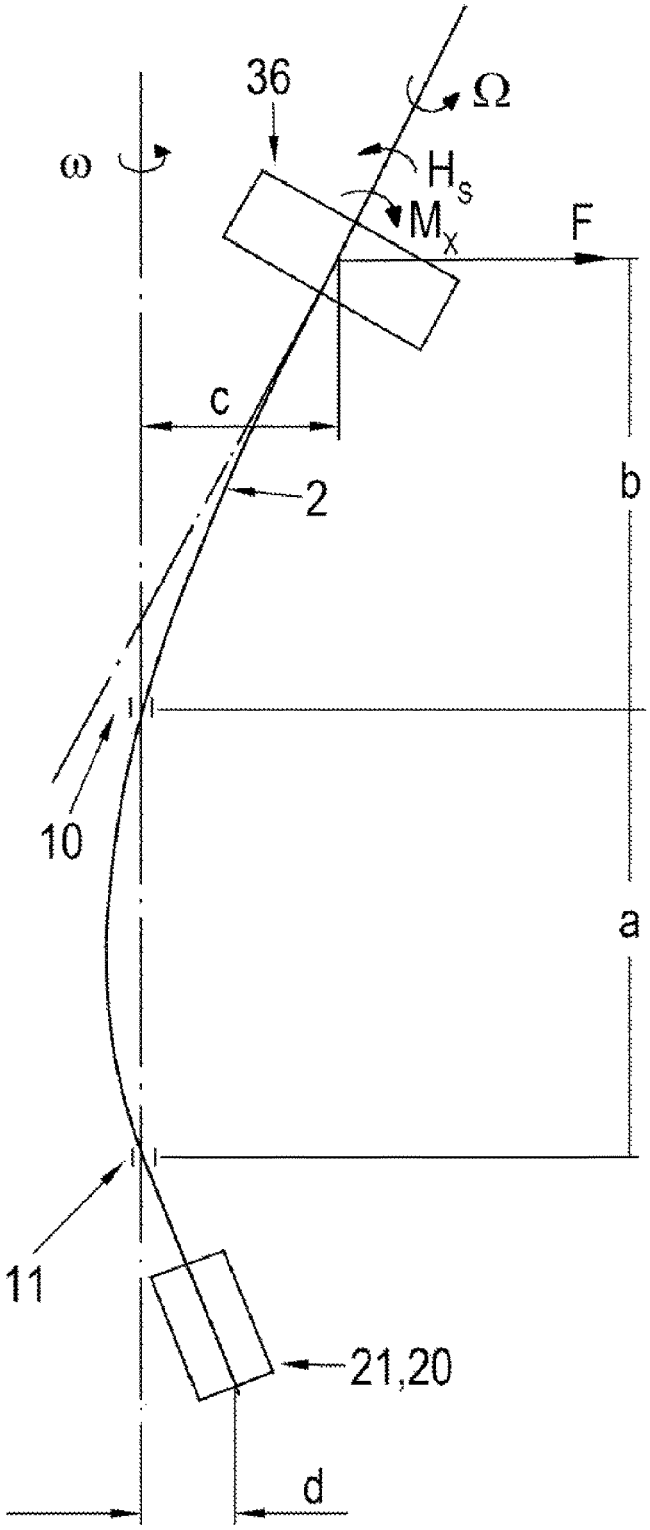
FIG. 7 shows a schematic diagram of the rotating elements of a separator.

FIGS. 1 and 2 show a drive apparatus 1 for a separator drum 36—which is not shown here, but shown schematically in FIG. 7—of a separator arrangement, wherein the separator drum is preferably designed for continuous product processing, has a vertical rotational axis, and for the clarification and/or separation of product phases has a packet consisting of separating plates installed in the drum. The drum can also preferably be of a single-cone or double-cone design.

The separator drum can be rotated by means of a drive spindle 2. The drum, which is not shown here, can be seated, or is seated in the installed state (at the top in FIG. 1), on the upper end of the drive spindle 2. To understand this feature, reference is additionally made to the prior art referred to in the introduction. The drive spindle 2, with a preferably vertical rotational axis, can be rotated by means of a drive apparatus 3, shown in FIG. 1, which is accommodated in a drive housing 4, from which are outwardly guided in this case only the drive spindle 2 and optionally and advantageously one or more fluid connections 5 (e.g. lubricant connections) and/or electrical connections 5' to preferably sealed lead-throughs 6, 7 from the drive housing 4. It is to be additionally mentioned that a terminal box 37 for electrical connections in a pressure-tightly encapsulated design can be arranged on the motor housing section 16.

One of more electrical leads are guided in one or more lead-throughs 6 through the drive housing 4 and especially through the motor housing section 16 into this. Preferably, only one electrical lead-through is guided into the actually encapsulated area (motor housing section 16).

In this case, the drive housing 4 is designed overall so that it complies with tests for explosion protection so that a "standardized" spark ignition test inside the housing does not lead to a flashover from the drive housing 4 to the outside. However, preferably not all the component parts of the drive are specially encapsulated.

This may be explained in more detail below.

The drive housing 4 has a plurality of elements. Counted among these elements is a bearing housing section 9, on the inside circumference of which are arranged one or more bearing devices 10, 11 for the rotatable support of the drive spindle. In this case, the bearing devices 10, 11 are designed as rolling bearings which are axially at a distance from each other. Each of these bearing devices 10, 11 can in turn consist of one or more rolling bearings. The upper bearing device 10 is also referred to as a neck bearing and the lower bearing device 11 as a foot bearing. The weight of the drum, of the drive spindle and of all parts associated therewith are supported in this case on a step 12 of the bearing housing 9 via the neck bearing. Towards the top, the neck bearing, via its inner ring(s), supports the spindle via a formed-on collar. The ring 28 is clamped between bearing inner ring and spindle collar in this case (see FIG. 6). Above the ring 28, towards the ring cover 29, there is a free space of 40>0.3 mm, especially >0.5 mm. The neck bearing 10 is therefore well secured against axial displacements.

The bearing housing section 9, in a flange region 13, is supported via one or more elastic element(s) 14 on a machine frame 15 which is only partially shown here.

Adjoining the lower end of the bearing housing section 9 is a motor housing section 16 that is designed in an explosion-proof type of construction, especially in a pressure-tightly encapsulated type of construction. In this case, the motor housing section 16 is tightly screwed on the bearing housing section 9 by screws 17. The motor housing section has a jacket—preferably cylindrical with ribs—and a lower cover 18 which in this case is also fastened on the motor housing section 16 by means of screws 19.

Arranged in the motor housing section 16 is an electric motor having a stator 20 and a rotor 21.

The stator 20 is advantageously fastened directly on the inside circumference of the motor housing section 16 here, which enables a particularly compact type of construction. The rotor 21, on the other hand, is fastened on the outside circumference of the drive spindle 2. In such a way, the drive spindle 2, at its end facing away from the drum, can be directly rotated by the electric motor.

Since the drive spindle 2 is influenced by the drum 36 of the separator (see the schematic diagram of FIG. 7 showing how the unbalance force F and gyroscopic torque Ms, Mx act upon the drum), it follows, for example, the movements within the rolling bearing clearance and the load deformation of the rolling bearings, and in the case of unbalances of the drum 36 which lead to radial deflections "c" (the real rotational axis Ω of the drum in this case lies at an angle to the actually intended vertical rotational axis ω) the spindle 2 is bent so that the rotor 21 moves radially relative to the stator 20 (FIG. 7, deflection "d") on account of the bend line.

Seated upon the drive spindle 2 is a lubricant collecting reservoir 8—serving for the collection of oil—which is connected to the drive spindle in a rotation-resistant manner and co-rotates with it accordingly during operation, and has a base towards the bottom, extending with this radially outward and then axially upward, wherein it radially encompasses the flange housing 9 in certain sections. Projecting into the lubricant collecting reservoir 8, in which a radial oil level is formed from the outside inward during operation with rotations of the drive spindle 2, is a non-rotating paring disk-like feed element 22 or a feed pipe for the pumping of oil which is arranged on the bearing housing section. The opening of the feed element 22 projects radially outward here.

The feed element 22 opens into a bore 23 in the bearing housing section 9, serving as an oil line 23. This oil line 23 in turn opens into the fluid connection/the lead-through 5 so that oil can be directed by means of an external circuit (with cleaning and cooling devices, if applicable). The cleaned and/or cooled oil can then be fed back by means of a further lead-through—not shown here—into the region of the bearings, especially the neck bearing. Alternatively, the oil line 23 can also be routed directly to the bearings so that the oil makes its way through these and back into the reservoir (for the oil circuit, see also German patent document DE 10 2007 061 999 A1, FIG. 1, for example).

The lubricant collecting reservoir 8 has an advantageous cylindrical shape in certain sections on its inside and outside circumference.

Formed at its upper end, radially towards the inside, is a shoulder 24 which extends to just in front of the outside circumference of the non-rotating bearing housing section 9, wherein a first gap 25 is formed, however, between these two parts, of which the one rotates and the other does not.

The motor housing section also has an upper cover part 26, which in the region of a step 38 preferably engages in a corresponding step of the jacket and is connected to this, forming a unit, which motor housing section on its inside circumference is preferably also penetrated by the lubricant collecting reservoir 8 and which furthermore also forms the part of the motor housing 16 which is attached to the bearing housing section 9. The cover part 26 can be screwed, for example, to the remaining motor housing 16.

Between the lubricant collecting reservoir—which during operation rotates with the drive spindle—and the cover part 26, a second gap 27 is formed.

Preferably, at least one of the gaps, or both gaps 25 and 27, is, or are, of narrow and axially long dimensions in such a way that no flames can penetrate outwards from the drive chamber through the gap, or gaps 25, 27. In principle, such gap dimensioning according to FIG. 1 at the gap 27 is sufficient since only this leads into a region in which electrical operating means are present or in which parts driven by electric energy are arranged. In such a way, the lubricant collecting reservoir 8 in a simple and advantageous way also forms a part of the pressure-tightly encapsulated motor housing section 16. The annular cover 26, which closes off the motor housing 16 towards the top between the motor and the bearing housing up to the gap 27, forms another essential part.

The diametrical position of the gap 27 is preferably calculated so that it lies on a larger diameter than the outside diameter of the rotor, which facilitates the assembly.

As a result, an effective explosion protection is achieved in an inherently simple constructional manner. It is essential that the gap 27 formed on the outside on the motor housing section 16 is formed/dimensioned in such a way that in the event of an explosion in the interior of the motor no flames/sparks can penetrate through it to the outside. In this case—unlike in the case of explosion-proof electric motors for other purposes—attention is especially to be paid in the case of gap dimensioning to changes of the position of the parts which rotate during operation on account of separator-induced movements and deformations. The gaps have to be dimensioned so that parts that rotate during operation on the one hand certainly do not butt against parts that inherently do not rotate during operation, but on the other hand an adequate flashover protection is still achieved. Since the gap during operation constantly changes as a result of the separator-induced movements and deformations because the rotating parts such as the drive spindle do not always lie in the center of the annular gap, consideration has not been given up now to a pressure-tight design of a separator drive, designed as a direct drive, which is arranged completely beneath the bearing arrangement and the rotor of which lies directly on the drive spindle, whereas the stator is fixed in the drive housing and is arranged elastically on the machine frame with the entire drive unit so that all the parts follow the precessional movement of the rotating parts. By means of a suitable embodiment in the inventive sense, however, a pressure-tight design is still possible. This especially applies if only a single rotary transmission lead-through is provided at one end of the motor housing since only here does the effect of the changing gap then have an impact, which as a result of suitable gap dimensioning can be controlled in such a way that the parts which rotate and do not rotate during operation do not directly come into contact at the gap but flashover protection is still ensured as a result of a sufficiently long and narrow gap.

Modifications, alternatives and equivalents are conceivable within the scope of the invention.

Thus, according to the exemplary embodiment of FIG. 2 the upper annular cover part 26, by its inside circumference, does not adjoin the lubricant collecting reservoir 8 but it extends radially close to the drive spindle 2, wherein a remaining gap 27' is again designed in such a way that during explosion tests or explosion in the motor no spark flashover from the motor housing section takes place. The outside diameter of the spindle can in this case be formed by the drive spindle 2 directly or by a sleeve or a corresponding sleeve section (not shown here) which encompasses the drive spindle 2.

As in the case of the embodiment according to FIG. 1, an electric lead-through can be guided into the motor housing section 16 in order to supply the motor with electric current. In this case, the lubricant collecting reservoir 8 lies completely above the cover part 26 or the motor housing 16 in a pressure-tightly encapsulated type of construction and itself does not form a part of the motor housing section 16. As a result of this, the construction in the axial direction is slightly longer than the construction according to FIG. 1, but realizes its advantages in other respects with regard to explosion protection.

Especially advantageous is the fact that the entire bearing device and the lubricating device lie completely outside the motor housing section 16 and that in this respect no special measures—especially no encapsulated type of construction—have to be taken on these sections of the drive housing 4, which are not to be electrically supplied with energy in order to still realize overall a drive for separators in an explosion-proof type of construction.

Advantageous measures, which serve or are necessary for the explosion-proof design overall, have also been taken on the sections of the drive apparatus which lie outside the pressure-tightly encapsulated area.

According to FIGS. 1 and 2, the bearing device has an upper neck bearing 10 and a lower foot bearing 11 that is axially at a distance from this so that the rotor is guided in the stator.

Figure 3:
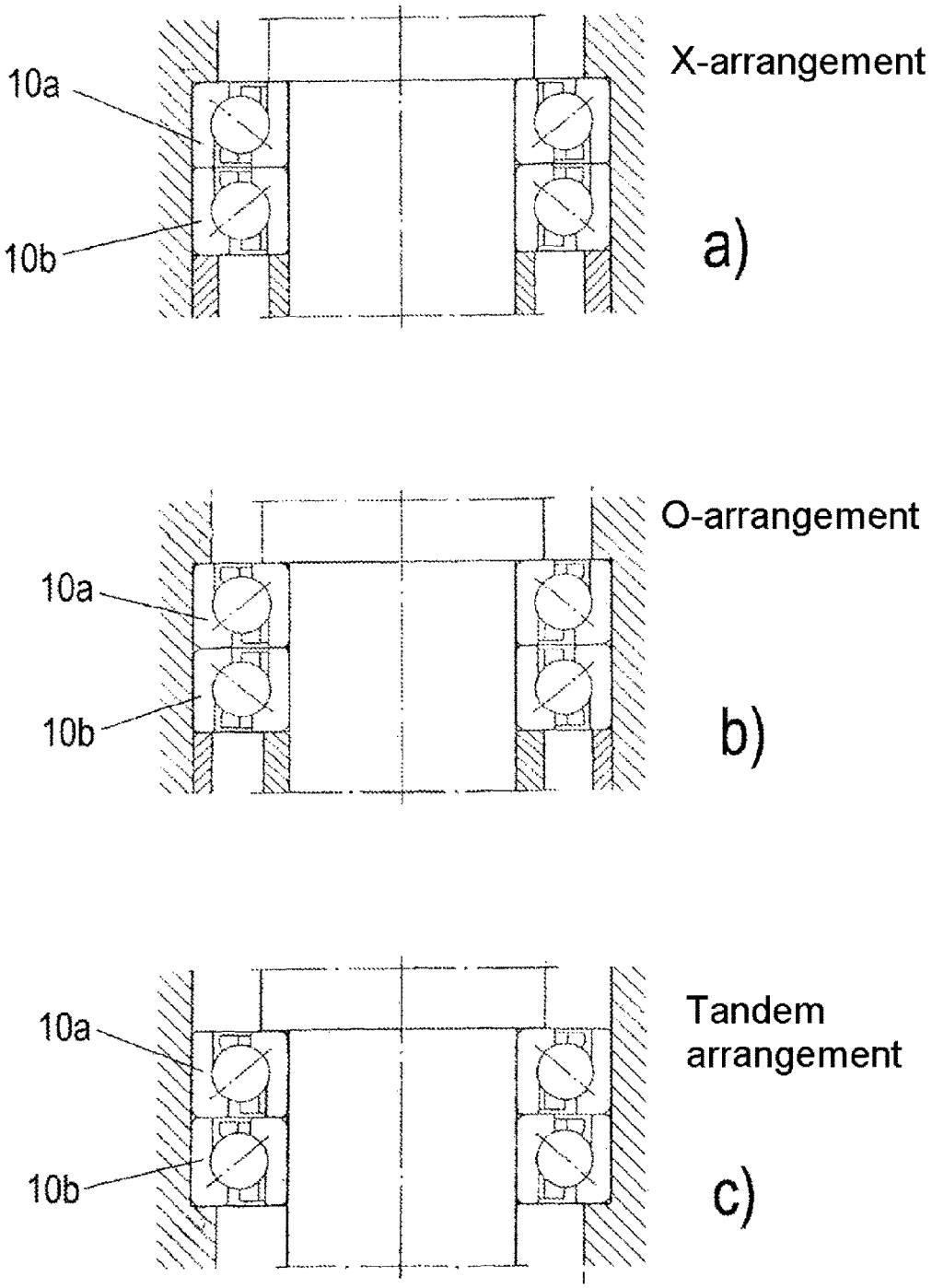
FIGS. 3*a*)-3*c*) show a schematic representation of three different bearing arrangements for a bearing device for a drive apparatus for a separator arrangement.

FIGS. 3*a*)-3*c*) illustrate that one of the bearings, preferably the upper neck bearing 10, has two individual rolling bearings which are designed as angular-contact rolling bearings 10*a, b* which are arranged on the drive spindle 2 in an X-, O-, or tandem design.

Preference is given to the X-arrangement and the O-arrangement in which both angular-contact rolling bearings (especially angular-contact ball-bearings) are fastened axially at the top and bottom on the drive spindle 2 by means of a ring or a spindle step in each case so that axially only a small clearance exists, which has an advantageous effect with regard to the gap dimensions. In FIGS. 1 and 2, the two bearings, shown in tandem arrangement in each case, are fastened axially at the bottom on the step 12 of the bearing housing and at the top by means of a ring 28, which is fastened on the drive spindle 2 and rotates with this, which ring in turn lies beneath the non-rotating annular cover 29 which is fastened (e.g. with screws) on the bearing housing section 9. In this case, a labyrinth-like seal against escape of oil towards the drive spindle is also formed. In the case of the further advantageous embodiment, in which the bearing arrangements and the housing section 4 together are integrated into the pressure-tightly encapsulated space, provision may also be made for only one gap 27" (between the annular cover 29 and the spindle 2) towards the drive spindle 2, which additionally/alternatively can be of a flameproof design (see the explanations in relation to FIG. 6). This gap 27", however, is provided as an addition in the case of the variant of FIG. 1.

In the case of X- or O-arrangements of the bearings, the ring 28, as an axial limiting element for the explosion case in the motor, can be omitted. In other respects, the material of the ring 28 or of the counterpart (annular cover 29) is preferably bronze or brass because in the explosion case the material pairing—preferably steel and bronze—counteract a spark development in a particularly effective manner.

Figure 4:
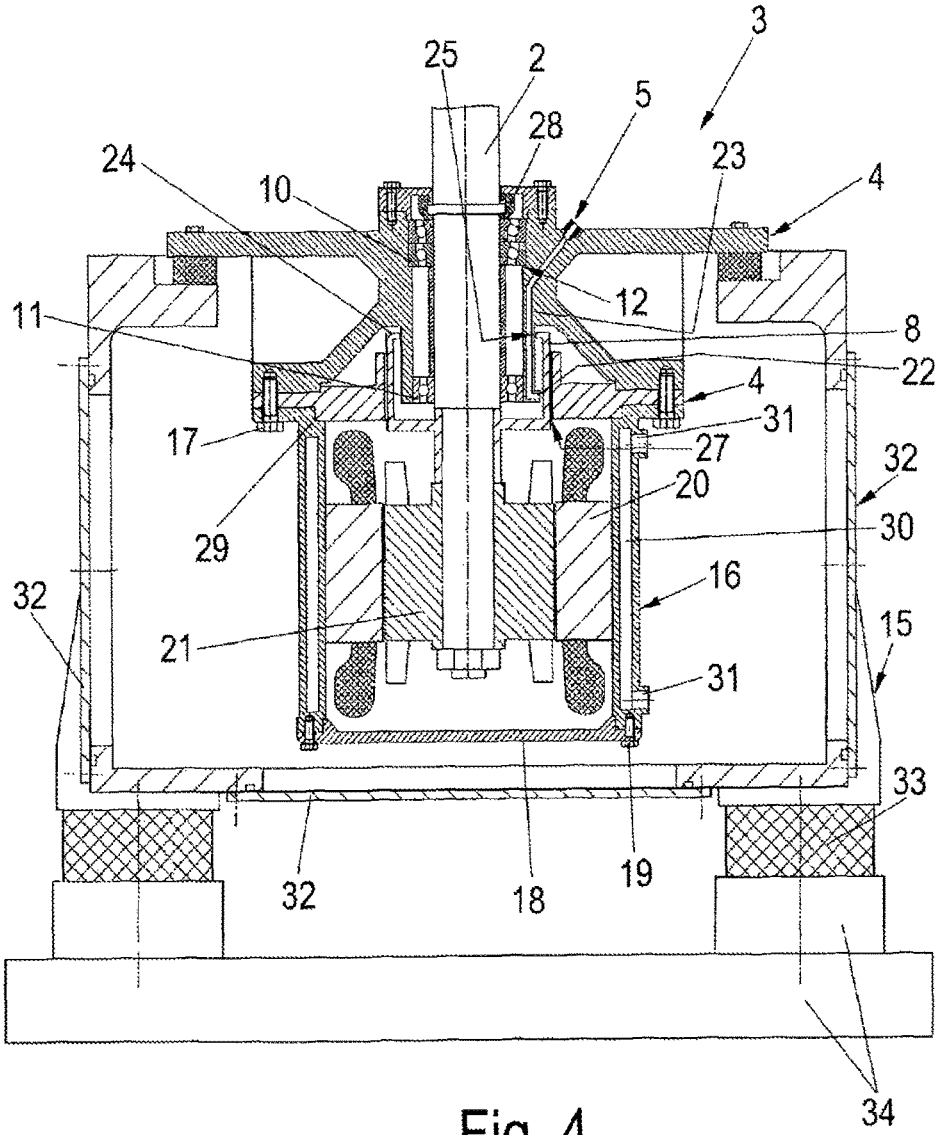
FIG. 4 shows a schematic representation of an embodiment variant of the drive apparatus according to the invention for a separator arrangement according to FIG. 1 with a complete machine frame.

Shown schematically in FIG. 4 is an embodiment variant of the drive apparatus 3 according to the invention for a separator arrangement according to FIG. 1. A difference to the embodiment according to FIG. 1 exists in a more clearly shown optional cooling jacket 30 in the motor housing section 16, which encloses the unit consisting of rotor 21 and stator 20 and in which can circulate cooling fluid that makes its way through the coolant connections 31 into the cooling jacket 30 or is transported out of this. Furthermore, the machine frame 15 at its openings has cover plates 32 fastened on the machine frame 15 by suitable connecting elements. By means of the cover plates 32, the drive apparatus 3 is located in a space that again is separated from the environment and can accommodate parts of the oil circulating device or lubricant cooling system. The space is not sealed towards the environment, however. The machine frame 15 is supported on a machine bed 34 preferably via damping elements 33.

Figure 5:
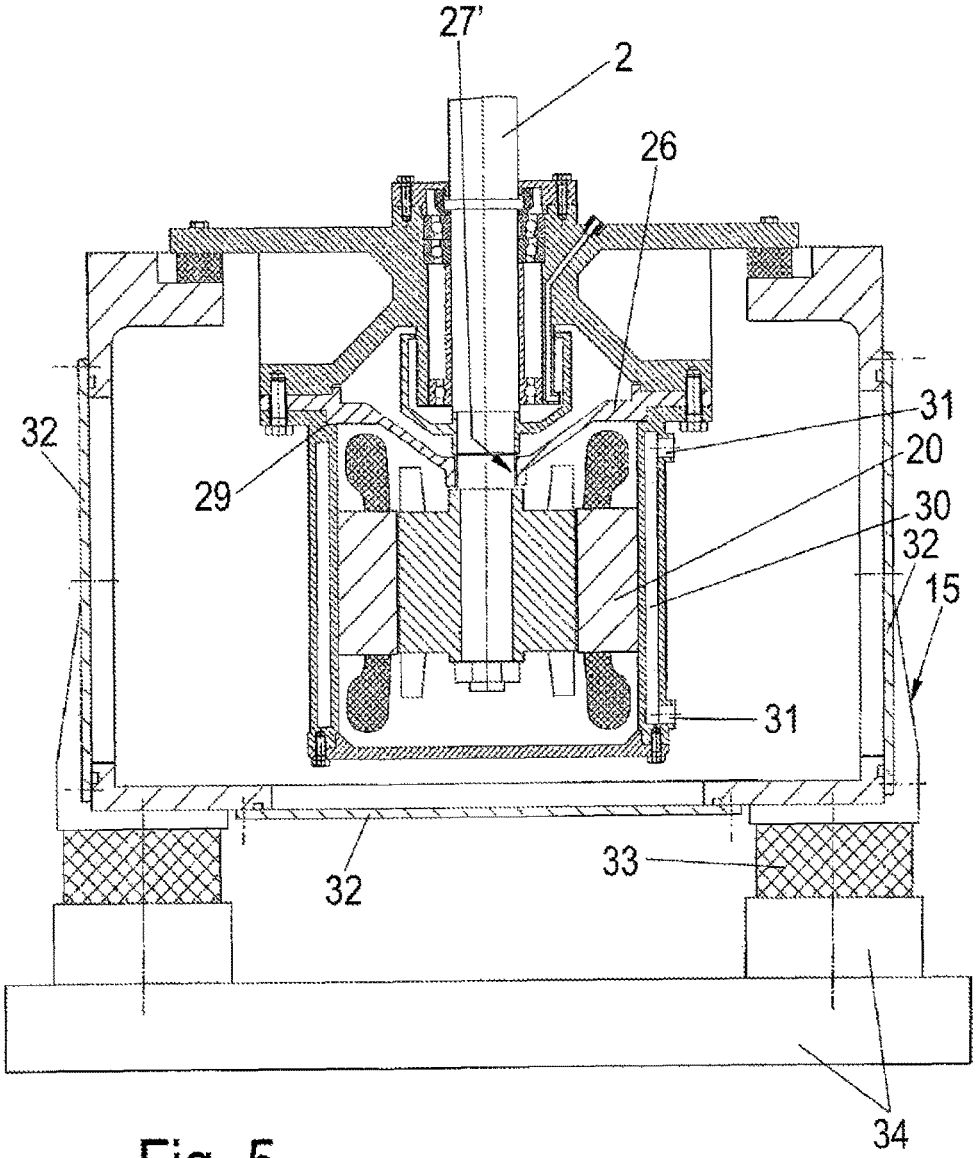
FIG. 5 shows a schematic representation of an embodiment variant of the drive apparatus according to the invention for a separator arrangement according to FIG. 2 with a complete machine frame.

Shown schematically in FIG. 5 is an embodiment variant of the drive apparatus 3 according to the invention for a separator arrangement according to FIG. 2. A change to the embodiment according to FIG. 2 again exists in the cooling jacket 30 enclosing the unit consisting of rotor 21 and stator 20 and in which can circulate cooling fluid which makes its way through the coolant connections 31 into the cooling jacket 30 and is transported out of this. Furthermore, the machine frame 15 at its openings has the cover plates 32 in this case also, which are fastened on the machine frame 15 by suitable connecting elements.

Figure 6:
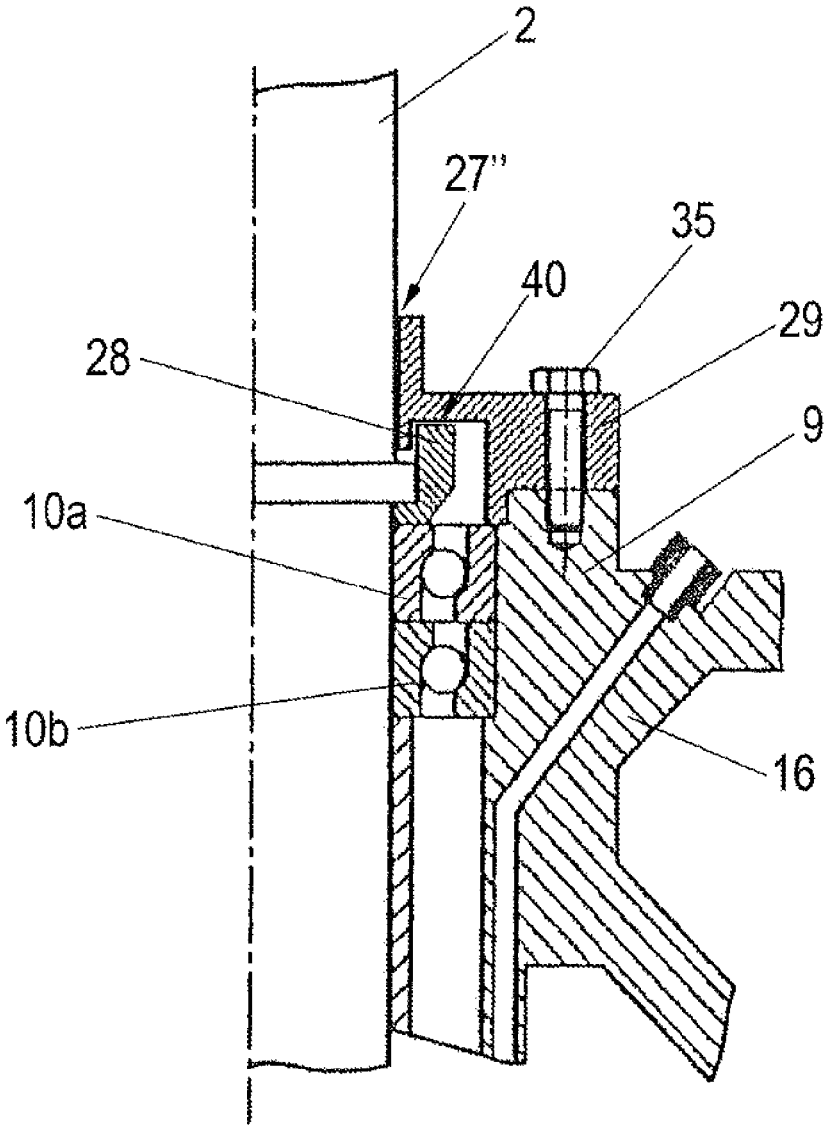
FIG. 6 shows a detail enlargement of a schematic representation of an embodiment variant of the drive apparatus according to the invention for a separator arrangement according to FIG. 2, which especially shows a bearing device for the drive apparatus.

A further variant is shown in FIG. 6. The variant according to FIG. 6 preferably features the tandem arrangement of the bearings according to FIG. 3*c*).

In this case, the bearing housing section (the annular cover 29 with the ring 28 which is fastened on the motor housing section 16 by bolts 35) is of a pressure-tight design in an encapsulated type of construction together with the motor housing section 16 in an explosion-proof type of construction and the gap 27" is formed radially on the inside on the annular cover 29 for the drive spindle 2 so that no flame/spark flashover into the explosion-proof space can take place at the gap. The cover part 26 can be omitted in the case of this variant. The openings 39 in the drive housing 4 would also be omitted.

The advantage of this variant is that the gap 27" lies very close to the bearing device (neck bearing) 10' which undertakes a very precise guiding of the rotating drive spindle 2 and of the stationary bearing cover 35 of the drive apparatus 3.

The bearing device 10, 11 in the case of this variant also is located in the pressure chamber of the motor, wherein the entire bearing arrangement of the drive spindle is again arranged above the rotor 21.

A grooved ball bearing is also conceivable as a thrust bearing. This, like the neck bearing 10*a*, 10*b*, is fixedly seated on the spindle 2 but, in contrast to this, has no contact by the outer ring with the bearing housing or the bearing cover.

This contact is made in the upward direction only as a result of an axial displacement of the entire rotating unit consisting of spindle 2, bearing arrangement and rotor 21 of the motor (in the event of an explosion in the interior of the motor) if the axial forces which then occur bring the outer ring of the grooved ball bearing into contact with the bearing cover of the unit. This variant is a possibility, for example, in the case of angular-contact ball bearings in tandem arrangement.

The axial length of the gaps 27, 27', 27" according to a configuration which is frequently also used for higher anticipated explosion pressures, is advantageously at least 25 mm and the largest associated radial gap width is at most 0.25 mm, which serve as a starting point of the design and tests so that flame/spark flashovers can be effectively prevented.

The necessary gap length and the gap width of the spindle lead-through are also formed in dependence upon the anticipated explosive volumes of the interior of the motor and the medium to be expected therewith which forms the explosive mixture.

The gaps 27, 27' are preferably therefore dependent upon medium and are dimensioned depending on the circumstances, specifically based on how this is prescribed in said standard for the gaps and taking consideration the separator-specific influences.

An example of another advantageous design for a free volume of the motor housing of more than 2 $dm^3$ and an anticipated explosion pressure of at most 10 bar requires a gap length of at least 12.5 mm and a maximum gap width of 0.2 mm as a basis for determining the necessary gap during separator operation.

Alternatively or optionally, the bearing housing section 9 and/or the lubricant collecting reservoir (section) 8 can also be designed in a pressure-tightly encapsulated type of construction (not shown here).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF DESIGNATIONS

Drive apparatus 1
Drive spindle 2
Drive apparatus 3
Drive housing 4
Fluid connections 5
Electrical connections 6
Leadthroughs 6, 7
Lubricant collecting reservoir 8
Bearing housing section 9
Bearing devices 10, 11

Step 12
Flange region 13
Elastic element 14
Machine frame 15
Motor housing section 16
Screws 17
Cover 18
Screws 19
Stator 20
Rotor 21
Feed element 22
Oil line 23
Shoulder 24
Gap 25
Cover part 26
Gap 27
Ring 28
Annular cover 29
Cooling jacket 30
Coolant connection 31
Cover plate 32
Damping element 33
Machine bed 34
Bolt 35
Separator drum 36
Terminal box 37
Step 38
Opening 39
Free space 40
Rotational axis D

The invention claimed is:

1. A drive apparatus for a separator drum with a vertical rotational axis and a feed line for a centrifuged material which is to be processed, the drive apparatus comprising:
- a direct drive motor having a stator and rotor;
- a drive spindle coupling the direct drive motor to the separator drum; and
- a drive housing in which the drive apparatus is arranged, wherein the drive apparatus has a motor housing section that is configured in an explosion-proof, pressure-tightly encapsulated type of construction and in which is accommodated the motor together with the stator and the rotor;
- wherein the drive housing consists of a plurality of sub-sections of which one is the motor housing section and another is a bearing housing section accommodating a bearing device for the drive spindle;
- wherein the motor housing section is configured as a section that is stationary during operation and is adjacent to a part that rotates during operation, wherein at least one gap is formed between the part that rotates during operation and the motor housing section;
- wherein the sub-sections comprise:
  - the bearing housing section, which is non-rotatable,
  - motor housing section, which is non-rotatable, and
  - a lubricant collecting reservoir connected to the drive spindle in a rotation-resistant manner;
- wherein the motor housing section has a cover part towards a top that is adjacent to the rotating part so that the at least one gap is formed between the cover part and the rotating part;
- wherein the at least one gap is formed between the cover part of the motor housing section and the lubricant collecting reservoir.

2. The drive apparatus of claim 1, wherein the at least one gap is dimensioned in such a way that flame/spark flashover through the at least one gap is not possible in the event of an explosion in an interior of the motor housing.

3. A drive apparatus for a separator drum with a vertical rotational axis and a feed line for a centrifuged material which is to be processed, the drive apparatus comprising:
- a direct drive motor having a stator and rotor;
- a drive spindle coupling the direct drive motor to the separator drum; and
- a drive housing in which the drive apparatus is arranged, wherein the drive apparatus has a motor housing section that is configured in an explosion-proof, pressure-tightly encapsulated type of construction and in which is accommodated the motor together with the stator and the rotor;
- wherein the drive housing consists of a plurality of sub-sections of which one is the motor housing section and another is a bearing housing section accommodating a bearing device for the drive spindle;
- wherein the motor housing section is configured as a section that is stationary during operation and is adjacent to a part that rotates during operation, wherein at least one gap is formed between the part that rotates during operation and the motor housing section;
- wherein the sub-sections comprise:
  - the bearing housing section, which is non-rotatable,
  - motor housing section, which is non-rotatable, and
  - a lubricant collecting reservoir connected to the drive spindle in a rotation-resistant manner;
- wherein the lubricant collecting reservoir lies outside the pressure-tightly encapsulated motor housing section.

4. The drive apparatus of claim 1, wherein a rotary transmission lead-through for one or more parts that rotate during operation is provided only on an upper side of the motor housing section.

5. The drive apparatus of claim 1, wherein a diametrical position of the at least one gap lies on a larger diameter than the outside diameter of the rotor.

6. The drive apparatus of claim 3, wherein the entire bearing device of the drive spindle is arranged above the motor housing section in such a way that the entire bearing device of the drive spindle is arranged axially above a lower base of the lubricant collecting reservoir.

7. The drive apparatus of claim 3, wherein the entire bearing device of the drive spindle is arranged outside and above, the motor housing section.

8. The drive apparatus of claim 1, wherein the lubricant collecting reservoir encompasses the drive spindle in an annular/toroidal manner and also forms a part of the pressure-tight encapsulation of the motor towards a bottom of the lubricant collecting reservoir.

9. The drive apparatus of claim 1, wherein the bearing device includes an upper neck bearing and a lower foot bearing.

10. The drive apparatus of claim 9, wherein the upper neck bearing includes two individual rolling bearings formed as angular-contact rolling bearings and arranged on the drive spindle in an X-, O-, or tandem design.

11. The drive apparatus of claim 10, wherein one or both of the bearings are fastened axially at a top and bottom on the drive spindle in each case by a ring or a spindle step.

12. The drive apparatus of claim 1, wherein the bearing housing section is supported on a machine frame by at least one or more spherical bearings.

13. The drive apparatus of claim 1, wherein the motor housing section is flanged onto the bearing housing section.

14. The drive apparatus of claim 1, wherein a natural frequency of the part that rotates is matched to a range of <1100 revolutions per minute.

15. The drive apparatus of claim 1, wherein a cover closes-off a bottom of the motor housing section.

16. The drive apparatus of claim 3, wherein the entire bearing device lies completely outside the pressure-tightly encapsulated motor housing section.

17. The drive apparatus of claim 1, wherein the entire bearing device lies completely inside the pressure-tightly encapsulated motor housing section.

18. The drive apparatus of claim 3, wherein the motor housing section has a cover part towards a top that is adjacent to the rotating part so that the at least one gap is formed between the cover part and the rotating part and wherein the at least one gap is formed between the cover part and the drive spindle.

19. The drive apparatus of claim 1, wherein a second gap is formed above the bearing device, between an annular cover above the bearing device and the drive spindle or a ring on the drive spindle.

* * * * *